US009446934B2

(12) United States Patent
Lin

(10) Patent No.: US 9,446,934 B2
(45) Date of Patent: Sep. 20, 2016

(54) DETECTING, MONITORING DEVICE OF THE HOOK ANGLE AND ITS CRANE

(71) Applicant: Handing Lin, Fuzhou (CN)

(72) Inventor: Handing Lin, Fuzhou (CN)

( * ) Notice: Subject to any disclaimer, the term of this patent is extended or adjusted under 35 U.S.C. 154(b) by 0 days.

(21) Appl. No.: 14/759,935

(22) PCT Filed: Dec. 27, 2013

(86) PCT No.: PCT/CN2013/090644
§ 371 (c)(1),
(2) Date: Jul. 9, 2015

(87) PCT Pub. No.: WO2014/108033
PCT Pub. Date: Jul. 17, 2014

(65) Prior Publication Data

US 2015/0353329 A1 Dec. 10, 2015

(30) Foreign Application Priority Data

Jan. 10, 2013 (CN) ..... 2013 1 0008857
Apr. 28, 2013 (CN) ..... 2013 1 0153481

(51) Int. Cl.
*B66C 13/46* (2006.01)
*B66C 13/16* (2006.01)

(52) U.S. Cl.
CPC ..... *B66C 13/46* (2013.01); *B66C 13/16* (2013.01)

(58) Field of Classification Search
CPC ..... B66C 13/46; B66C 13/16; G01C 9/00
USPC ..... 33/333, 366.11
See application file for complete search history.

(56) References Cited

U.S. PATENT DOCUMENTS 2,362,616 A * 11/1944 Cloud ..... G01C 9/08 180/65.1
2,414,092 A * 1/1947 Charwinsky ..... B66C 1/40 294/82.1
2,772,411 A * 11/1956 Cooper ..... G01C 9/06 116/303
3,865,265 A * 2/1975 Brudi ..... B66F 17/003 212/277

(Continued)

FOREIGN PATENT DOCUMENTS

CN 102431897 A 5/2012
CN 102485632 A 6/2012

(Continued)

OTHER PUBLICATIONS

Handing Lin, A Detection device of the crane hook perpendicularity deviation,Technological Development of Enterprise, Aug. 2012, vol. 31 No. 23, p. 109-110.

*Primary Examiner* — Christopher Fulton

(57) ABSTRACT

The present invention provides a detecting and monitoring device of the hook angle and its crane; a preferred embodiment thereof is to lengthen the two side-fenders of a movable pulley of the crane raising pulley assembly by equal amounts so that a platform can be fixed on the vacant space between the inner sides of the lengthened fenders. The platform is installed in such a way that the platform surface is a horizontal plane when the hook deviation angle is 0 degree. An angle measuring instrument is disposed on the platform surface and used to detect hook angle in real-time. The hook angle is shown in crane operator's cab by a wireless transmitter to control the crane, eliminate the hook angle deviation, and provide the basis of the vertical lifting. The embodiment can be applied to stand-alone lifting, double machine hoisting, or main and auxiliary machine hoisting. The device can be suitably installed on mobile cranes.

17 Claims, 6 Drawing Sheets

(56) References Cited

U.S. PATENT DOCUMENTS

| | | | | |
|---|---|---|---|---|
| 4,452,078 | A * | 6/1984 | Formanek | E02F 9/264 33/366.11 |
| 5,596,826 | A * | 1/1997 | Barden | E02F 9/26 172/430 |
| 6,549,139 | B2 * | 4/2003 | Shaw, Jr. | B66C 13/44 212/276 |
| 6,829,835 | B2 * | 12/2004 | Pfeil | B66F 9/082 33/333 |
| 7,856,727 | B2 * | 12/2010 | Chiorean | E02F 9/265 33/1 N |
| 8,618,949 | B2 * | 12/2013 | Maynard | B66C 15/045 212/276 |
| 9,108,826 | B2 * | 8/2015 | Eriksson | B66C 13/06 |
| 2015/0217976 | A1 * | 8/2015 | Tanizumi | B66C 13/46 703/2 |

FOREIGN PATENT DOCUMENTS

| | | | |
|---|---|---|---|
| CN | 102815614 | A | 12/2012 |
| CN | 103130098 | A | 6/2013 |
| CN | 103213902 | A | 7/2013 |
| CN | 103318765 | A | 9/2013 |
| JP | 2001002369 | A * | 1/2001 |
| JP | 2005145684 | A | 6/2005 |
| JP | 2009078878 | A | 4/2009 |
| SU | 1257050 | A1 | 9/1986 |

* cited by examiner

DETECTING, MONITORING DEVICE OF THE HOOK ANGLE AND ITS CRANE

BACKGROUND OF THE INVENTION

The present invention relates to the field of cranes, and more particularly relates to a detecting and monitoring device for the hook angle of a crane. The present invention also relates to a crane with a detecting and monitoring device for the hook angle.

Cranes requirement vertical lifting, as stipulated in construction specifications of cranes. The hook angle should not exceed 3 degrees when using a mobile crane lifting a workpiece. However, so far there are no vertical lifting displays on cranes. As a consequence, crane drivers cannot determine whether the hooks are in the vertical position. Though the vertical information of a hanged workpiece may be provided by a hoisting commander who observes the workpiece constantly, such information is neither timely and accurate.

For many years, the detection of the hook angle of a crane is obtained by detecting the angle of the steel rope of the hook or through the machine vision technology to detect the verticality of the hook. In addition, another method that is mentioned in the patent with the application number CN2011103601730 is to directly detect the deviation of the action line of lifting force to the plumb line. During the process of lifting, the hook and the lifting pulley assembly of the crane have identical deviations, and there is a laser generator fixed on the lifting pulley assembly of the crane, the light spot in the reflecting surface of the reflector body transmitted by the laser generator, the position corresponding angle value indicate by the concentric circles, and dynamic display declination angle direction and the declination angle degrees of the hook. The patent with the application number CN2011103871994 mentions a measurement platform that is mounted on the outside of the fender of the movable pulley of the lifting pulley assembly of crane, where the measurement platform surface is horizontal when the vertical deviation angle is zero, a vertical coordinate system is set on the measurement platform surface, and a biaxial inclinometer is also set up to measure the vertical deviation angle of the X-axis and Y-axis.

There are many styles of lifting pulley assembly relating to the detection of the hook angle, and the parts of the lifting pulley assembly are not uniformly defined and named. The following are two typical existing pulley hook assembly. FIG. 1 is a schematic view of a lifting pulley assembly setting up two sides of the fender for lifting. In the FIG. 1, 1—fixed pulley, 2—moved pulley, 3—steel rope, 4—fender, 5—hook. FIG. 2 is an schematic view of a lifting pulley assembly with an additional board between the lifting pulley assembly and the hook: 1—moved pulley, 2—pulley shaft, 3—fender or shield of the fender, 4—hook, 8—a board added between the lifting pulley assembly and the hook, where the hook is fixed on the hook beam 6 by nut 5, and a bearing 7 is set between the nut and the hook beam 6.

SUMMARY OF THE INVENTION

The purpose of the present invention is to prevent oblique hanging, to control the deflection of the hook, and to provide a detection device of the hook of a crane that allows the crane to hoist vertically and have a large installation space for device installation and protection, real-time detection of the hook angle and the addition of co-party display. The invention is suitable not only for stand-alone lifting, but also for the detection and monitoring of the lifting operation. It also allows installing high-capacity rechargeable battery in the detecting device of the hook angle or charging means conditions provided high-capacity rechargeable battery, or creating conditions of a direct power supply device. Another object is to provide a crane comprising said detecting and monitoring device of the hook angle. The fenders described in present invention are on both sides of the pulley or connected pulley shaft and the hook beam. They may be called guards, splints, choke plates, vertical plates, all of such parts are herein collectively referred to as fenders. FIG. 1 and FIG. 2 are two typical existing pulley hook assemblies, where the hook angle, or called the deviation of hoist swing angle, is the action line of lifting force of the pulley assembly deviating from the plumb line.

The present invention provides a detecting device of the hook angle, which is used for the crane and includes at least one angle measuring instrument. Between a movable pulley of the crane raising pulley assembly and a hook or between a fixed pulley and a fixed point of the raising pulley assembly is installed in series a part, which meets the requirement that a platform surface fixed on the said part is a horizontal plane when the hook deviation angle is 0 degree, and, under different deviation angles of the hook, the action line of the lifting force of the pulley assembly which passes through the hook is still perpendicular to the said part on the platform surface fixedly installed on the said part. For example, between the fixed pulley and the fixed point of the lifting pulley assembly of crane is cascaded a part; the part and the lifting pulley assembly are a shackle joint and not a welding connection in order to ensure that the part swings with the hook during the lifting of the crane and meets the requirement that, under different deviation angles of the hook, the action line of the lifting force of the pulley assembly which passes through the hook is still perpendicular to the platform surface fixedly installed on the said part; a platform is fixedly installed on the part with the plane of the platform being a horizontal plane when the hook angle is 0 degree; the angle measuring instrument is installed on the plane of the platform for detecting the inclination of the plane of platform to the horizontal plane.

In a preferred embodiment, one end of the part is fixed on both sides of the fender of the movable pulley or fixed pulley. Because the part is fixedly connected with the movable pulley or fixed pulley, the coordinates established on the platform of the part use the respective movable pulley or fixed pulley as a reference, and the movable pulley or fixed pulley are relatively clear and direct for observation, which is convenient for determination of the orientation of the hook angle.

In a second preferred embodiment, when one end of the part is fixed on both sides of the fender of the fixed pulley, the length of both sides of the fender of the fixed pulley are increased, and the part is comprised of the increased length of both sides of the fender. On the ridge of the fender set up a hanger shaft to install the rings; the rings use the shackle joint with the fixed point of the lifting pulley assembly of crane, thereby widening the distance between the pulley assembly and the hanger shaft, and providing the space for loading the detecting device of the hook angle. Between the fixed pulley and the fixed point of the lifting pulley assembly of crane is cascaded a part; and one end of the part is fixed to both sides of the fender of the fixed pulley; by respectively increasing the same length of the both sides of the fender, the platform can be fixed on the inside of the vacant space of the increased length of the fender with the plane of platform being a horizontal plane when the hook angle is 0 degree; on the plane of platform is provided an angle measuring instrument. By installing the part between both sides of the fender, the structure is simplified and it is conducive to install and protect the detecting device of the hook angle. If a wireless transmission device is installed on one side or both sides of the fender, non-magnetic glass should be used for manufacturing the fender.

In a third preferred embodiment, the detecting device of the hook angle can detect the hook angle or output and display the hook by using a microcontroller based on the detected value of the hook angle. The angle measuring instrument can be used to detect the inclination of the platform surface to the horizontal surface; or a biaxial angle sensor may be used for detecting the two-dimensional tilted angle of the plane of platform with respect to the horizontal plane; or a triaxial angle sensor may be used for detecting the three-dimensional tilted angle of the plane of platform with respect to the horizontal plane; or a combination of angle measuring instrument for detecting the tilted angle of the plane of platform with respect to the horizontal plane. When there is a hook angle, the angle between the platform plane and the horizontal plane is ∠A, and ∠A is equal to the vertical deviation angle of lifting pulley assembly of cranes or the hook angle ∠B (as shown in FIG. 3, because ∠C=∠D=90°, so ∠A=∠B), the projection of the hook angle in the platform plane that is perpendicular to the intersection line of the platform plane and the horizontal plane. In addition, the hook angel can also be determined by biaxial angle measuring instrument for detecting the inclination of platform plane with respect to the horizontal plane; because the angle between the platform plane and the horizontal plane is numerically equal to the hook angle, and the hook angle is detected only within a few degrees, thus, based on the sum of the squares of axial inclination of two-dimensional including X axial and Y axial is approximately equal to the square of the angle of the platform plane with respect to the horizontal plane, and on the basis of the axial inclination values of two-dimensional including X axial and Y axial to output the hook angle or the angel of inclination of the platform plane with respect to the horizontal plane by the microcontroller of the detecting device. Similarly, based on the value of the angle between the platform plane and the horizontal plane is equal to the hook angle, it can also be applied to triaxial angle measuring instrument; set up the three-axis Cartesian coordinates in the middle of the platform plane and provide a triaxial accelerometer for measuring the inclination angle of platform plane. Through the use of a microcontroller, transform the voltage outputting by the three-axis accelerometer into the output of the angle or the hook angle and display it on an LCD. Also based on that the value of the angle between the platform plane and the horizontal plane is equal to the hook angle, it will be available for the combination of angle measuring instrument.

In a fourth preferred embodiment, on the plane of the platform is provided a universal level instrument for detecting the tilted angle of the plane of platform with respect to the horizontal plane; or provided a biaxial angle sensor for detecting the two-dimensional tilted angle of the plane of platform with respect to the horizontal plane; or provided a triaxial angle sensor for detecting the three-dimensional tilted angle of the plane of platform with respect to the horizontal plane; or provided a laser angle measuring instrument for detecting the tilted angle of the plane of platform with respect to the horizontal plane.

Because the value of the angle between the platform plane and the horizontal plane is equal to the hook angle, by letting $\alpha$, $\alpha_x$, $\alpha_y$ be the hook angle of the crane, the axial component of the angle between the platform plane and the horizontal plane of the X axis and Y axis, respectively, it can show that: $(\alpha_x)^2+(\alpha_y)^2\approx(\alpha)^2$, and that the axial angle of the projection of the hook angle deviating from the X axis is $\beta_x=\arctan[(\alpha_y)/(\alpha_x)]$. So, by using a microcontroller, we can output or display the hook angle value and the projection of the hook angle deviating from the X axis on LCD in real-time. The universal level instrument in this application can detect and directly display the tilted angle of the plane of platform with respect to the horizontal plane. The traditional universal level instrument with bubble display, although simple, inexpensive, and easy to maintain, etc., cannot be used in motion detection.

The present invention also discloses a monitoring device of the hook angle used for a crane, comprising at least one angle measuring instrument, a detecting device of the hook angle and a wireless transmitting device for transmitting the signal of the hook angle, and a plurality of receiving device for receiving and processing the wireless signal and displaying the hook angle mounted in the crane operator's cab, where between a movable pulley of the crane raising pulley assembly and a hook or between a fixed pulley and a fixed point of the raising pulley assembly is installed in series a part, which meets the requirement that the platform surface is a horizontal plane when the hook deviation angle is 0 degree and that, under different deviation angles of the hook, the action line of the lifting force of the pulley assembly which passes through the hook is still perpendicular to the platform surface; on the said part is fixedly installed the platform surface, which meets the requirement of when the hook deviation angle is 0 degree, the said platform surface is a horizontal plane; on the said platform surface is installed the angle measuring instrument that detects the inclination angle between the said platform surface and the horizontal plane.

In a preferred embodiment, one end of the part is fixed on both sides of the fender of the movable pulley or fixed pulley.

In a second preferred embodiment, between the fixed pulley and the fixed point of the lifting pulley assembly of crane is cascaded a part, and one end of the part is fixed on both sides of the movable pulley; both sides of the fender of the fixed pulley are lengthened by equal amount so that the platform can be fixed on the inside of the vacant position of the increased length of the fender; a wireless transmitting device used for transmitting the signal of the hook angle and a battery to supply the power to the wireless transmitting device are installed on the part.

In a third preferred embodiment, on the plane of the platform is provided a universal level instrument for detecting the tilted angle of the plane of platform with respect to the horizontal plane; or provided a biaxial angle sensor for detecting the two-dimensional tilted angle of the plane of platform with respect to the horizontal plane; or provided a triaxial angle sensor for detecting the three-dimensional tilted angle of the plane of platform with respect to the horizontal plane; or provided a laser angle measuring instrument for detecting the tilted angle of the plane of platform with respect to the horizontal plane.

When one end of the part is fixed on both sides of the fender of the movable pulley, the length of both sides of the fender of the movable pulley are increased. On the bottom of the fender set up a fixed a beam; the hook still set on both sides of the symmetrical center line of the fender; the hook is fixed to the beam by a nut, thereby widening the distance between the pulley assembly and the hanger shaft, and providing the space for loading the detecting device of the hook angle; when the plane of the platform is a horizontal plane when the hook angle is 0 degree or under the different angles, then mount the detecting device inside of the vacant position that is between the both sides of the fender of the movable pulley. There is another plan: a detecting device of the hook angle inside of the fender of the movable pulley, which is use for the crane, comprising at least one angle measuring instrument, where the hook still set on both sides of the symmetrical center line of the fender; both sides of the fender are increased by a same length so that a platform can be placed on the increased position of the fender plate; and the plane of the platform is a horizontal plane when the hook angle is 0 degree; and an angle measuring instrument is provided for detecting the inclination of the plane of platform to the horizontal plan. By installing the part between both sides of the fender, the structure is simplified and it is conducive to install and protect the detecting device of the hook angle.

In a fourth preferred embodiment, on the plane of the platform is provided a universal level instrument for detecting the tilted angle of the plane of platform with respect to the horizontal plane; or provided a biaxial angle sensor for detecting the two-dimensional tilted angle of the plane of platform with respect to the horizontal plane; or provided a triaxial angle sensor for detecting the three-dimensional tilted angle of the plane of platform with respect to the horizontal plane; or provided a laser angle measuring instrument for detecting the tilted angle of the plane of platform with respect to the horizontal plane.

The present invention further discloses a monitoring device of the hook angle inside of the fender of the movable pulley, which is use for a crane, comprising at least one angle measuring instrument, a detecting device of the hook angle, a wireless transmitting device for transmitting the signal of the hook angle, and a reception control device mounted in the crane operator's cab for receiving and processing the wireless signal and displaying the hook angle, where both sides of the fender of the movable pulley are increased by a same length so that a platform can be fixed on the inside of the vacant position of the increased length of the fender and that the plane of platform is a horizontal plane when the hook angle is 0 degree; a wireless transmitting device is installed for transmitting the signal of the hook angle and a battery to supply the power to the wireless transmitting device. By installing the part between both sides of the fender, the structure is simplified and it is conducive to install and protect the detecting device of the hook angle. If a wireless transmission device is installed on one side or both sides of the fender, non-magnetic glass should be used for manufacturing the fender.

In a preferred embodiment, on the plane of the platform is provided a universal level instrument for detecting the tilted angle of the plane of platform with respect to the horizontal plane; or provided a biaxial angle sensor for detecting the two-dimensional tilted angle of the plane of platform with respect to the horizontal plane; or provided a triaxial angle sensor for detecting the three-dimensional tilted angle of the plane of platform with respect to the horizontal plane; or provided a laser angle measuring instrument for detecting the tilted angle of the plane of platform with respect to the horizontal plane.

Up-lifting and hoisting are both single basic operations of mobile cranes. Hoisting requires collaborative lifting; both lifting sides should be operated based on dynamic changes in the hook angles of the main hook and collaborative party hook. Especially when both main crane and auxiliary crane are of large vertical cranes, the speed ratio of the auxiliary crane and the main crane should be kept equal to the slope of the connection point between the main crane and the auxiliary crane in order to achieve vertical lifting. Moreover, the absolute value of the hook declination produced by the main crane and the auxiliary crane are approximately inversely proportional to the load of the main crane or the auxiliary crane. If the load ratio of the main crane and the auxiliary crane is 4:1, when the angel of declination of the main crane has a hysteresis of 0.75° (which is difficult to detect), the angel of declination of the auxiliary crane can be ahead by 3°; if the elevation angle of the large vertical crane is 75°, the load undertook by the auxiliary crane is 1.25 times of that when the hook angle is 0°. Furthermore, when the hook angle of the auxiliary crane reaches the allowable value, the hook angle of the main crane msut meet the requirements. The driver of the main crane and auxiliary crane must operate on a condition that hook angle of the auxiliary crane is not greater than the permissible value. Therefore, it is necessary to simultaneously display the hook angle of the auxiliary crane in the main and auxiliary operating room timely. In addition, Hoisting a vertical weight by the single slip method should be cooperated between the lifting crane and other dragging machinery in order to achieve vertical lifting, in which case it is also necessary to dynamic display the hook angle on the collaborative machinery monitoring positions.

Due to the fact that independent force points for hoisting is less than or equal to 3, hoisting is generally carried out by two or three cranes. It is possible to design a universal cooperative party monitoring devices for the two or three cranes.

The present invention further discloses a monitoring device of the hook angle with a cooperating display, which is use for the crane, comprising at least one angle measuring instrument, a detecting device of the hook angle, a wireless transmitting device for transmitting the signal of the hook angle, and a reception control device mounted in the crane operator's cab for receiving and processing the wireless signal and displaying the hook angle, wherein (1) both sides of the fender of the movable pulley are increased by a same length so that a platform can be fixed on the inside of the vacant position of the increased length of the fender and that the plane of platform is a horizontal plane when the hook angle is 0 degree; a set of two channel remote switching wireless transmitting device switched by a remote switch or a set of three channel remote switching wireless transmitting device switched by remote switch, a battery for supplying power to the device, and an angle measuring instrument for detecting the inclination of the plane of platform to the horizontal plane are disposed on the platform; there has been fitted in the crane operator's cab with two sets of two channels receiving device matching with the two channel wireless transmitting device or three sets of three channel receiving device matching with the three channel wireless transmitting device.

(2) a set or more receiving device matching with the wireless transmitting device and with the same switching channel is installed in the crane operator's cab.

The above-mentioned remote switch of the wireless transmitting device is installed in the crane operator's cab.

The three-channel wireless transmission device switching by the remote switch are used for three cranes or two cranes to lift a heavy weight. The two-channel wireless transmission device switching by the remote switch are used for two cranes. A wireless transmitting device and its support of the receiving device according to the monitoring device of the hook angle with co-party display is set up in each crane, so that the crane can be used not only for normal operation, but also for crane lifting with co-party display.

When the crane is lifting, each crane occupies a channel through the remote switch located in the crane operator's cab, and the receiving device located in the crane operator's cab, except for one receiving device switch to the native channel for dynamically displaying the hook angle outside of the crane operator's cab, and make the other receiving device switch to the cooperating channel for receiving the signal of the cooperating crane and dynamic display the hook angle in the screen of the crane operator's cab.

The receiving device is provided on the monitor location of the lifting with the cooperating parties, or provided on the monitor location of the crane or other machinery without co-party display.

Because the value of the angle between the platform plane and the horizontal plane is equal to the hook angle, the projection of hook angle in the platform plane is perpendicular to the intersection line of the platform plane and the horizontal plane. The component of the hook angle projecting in the platform plane is located on the X axis and Y axis, and positive or negative signs are used to display its orientation of the component of hook angle. Thus the orientation of the component of the hook angle uses the coordinate system set up on the platform plane as reference. It also can be equipped with an azimuth measuring instrument by reference to magnetic if higher requirements are required, and establish the coordinates in the platform plane, provide the angle measuring instrument and the magnetic measuring instrument in order to calculate and detect the direction of the plane rotation angle of the hook to the magnetic north as the initial angle (should make error compensation to rotation angle due to the surrounding magnetic interference), and process the measured signal through a wireless transmitting device, and through the microcontroller information processing module to achieve the acquisition and operation of the sensor signal, which will be sent through the data transmission module matching the receiving device installed in the crane operator's cab, and display the hook angle and the azimuth in the LCD in real-time, by observing electronic compass scale provided in crane operator's cab, thus can get the right direction.

Disclosed here is a monitoring device of the hook angle and the magnetic azimuth, which is use for the crane, comprising at least one angle measuring instrument, a detecting device of hook angle, a wireless transmitting device for transmitting the signal of the hook angle and the magnetic azimuth, a receiving device mounted in the crane operator's cab for receiving and processing the wireless signal and displaying the hook angle and the magnetic azimuth in real time, and a platform fixed on a vacant space located between the inner sides of the fender of the movable pulley with the fenders being equally lengthened to provide said space. The plane of the platform is horizontal when the hook angle is 0 degree, and the angle measuring instrument and a geomagnetic field measuring instrument for detecting the inclination of the plane of platform to the horizontal plane is disposed on the platform.

In a preferred embodiment, the angle measuring instrument set up in the center of the surface of the lower platform is a three-axis accelerometer; the installation of geomagnetic field measuring instrument is a triaxial geomagnetic field magnetometer; the Z axis of the three-axis accelerometer and three-axis magnetometer lies on a straight line; the X axis and the Y axis of the three-axis accelerometer and three-axis magnetometer parallel to each other.

The crane in this invention comprises the detecting device of the hook angle, or the monitoring device of the hook angle, or the detecting device of the hook angle inside of the fender of the movable pulley, or the monitoring device of the hook angle inside of the fender of the movable pulley, or the monitoring device of the hook angle adding cooperating display or the monitoring device of the hook angle and the magnetic azimuth.

The present invention can overcome problems where vertical lifting is required without hook angle display during hoisting. The purpose of the present invention is to prevent oblique hanging, control deflection of the hook, and provide a detecting device of hook that allows crane vertical hoisting. It also offers a large installation space not only for both device installation and protection, but also for real-time detection of hook angle and for addition of co-party display. It can be used not only for stand-alone lifting, but also for detecting and monitoring device of the lifting operation, and in a crane comprising the detecting and monitoring of device. The crane driver can control the crane, eliminate the hook deviation angle, and achieve the vertical lifting according to the dynamic display of the hook angle on the screen.

DETAILED DESCRIPTION OF THE PREFERRED EMBODIMENT

Figure 1:
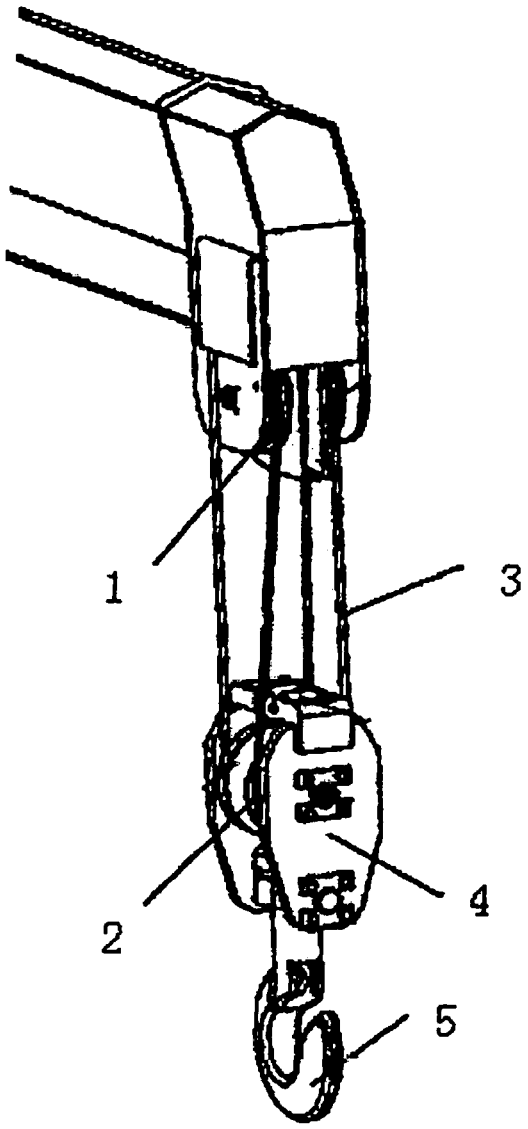
FIG. 1 is a schematic view of a pulley assembly setting up two sides of the fender for lifting.
Figure 2:
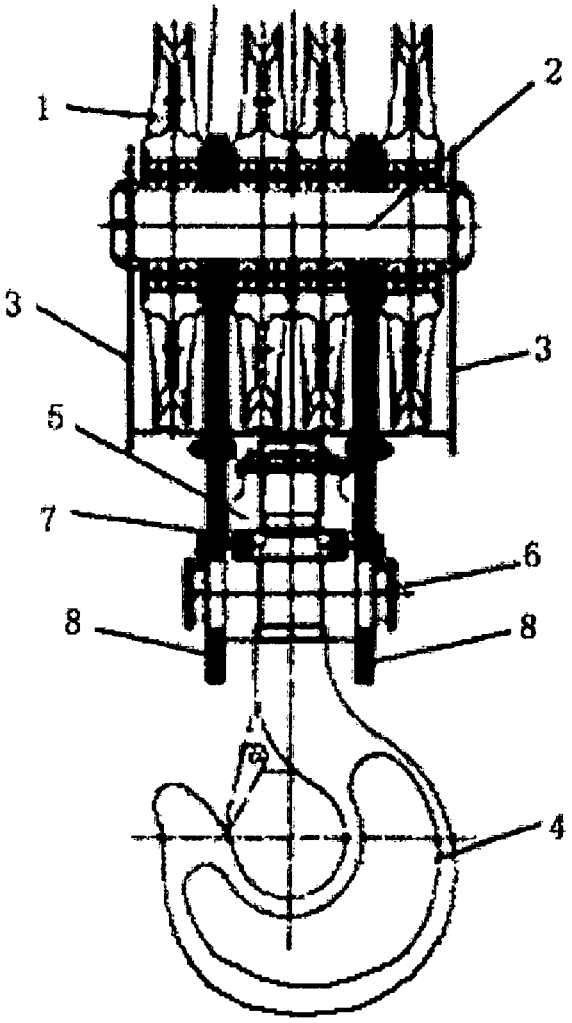
FIG. 2 is a schematic view of the lifting pulley assembly with the fender between the pulley assembly and the hook.
Figure 3:
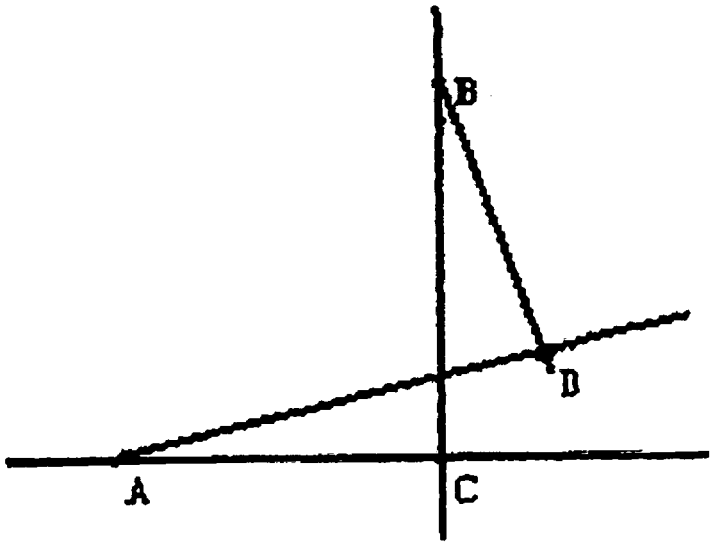
FIG. 3 is an illustration of the detection principle of the vertical deviation of the hook.
Figure 4:
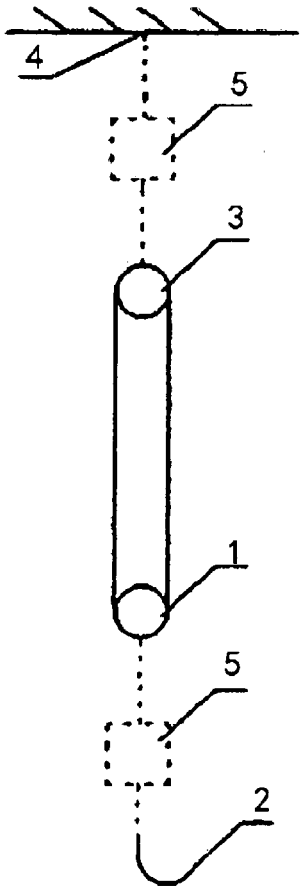
FIG. 4 is a schematic view of the implement structural of the present invention.
Figure 5:
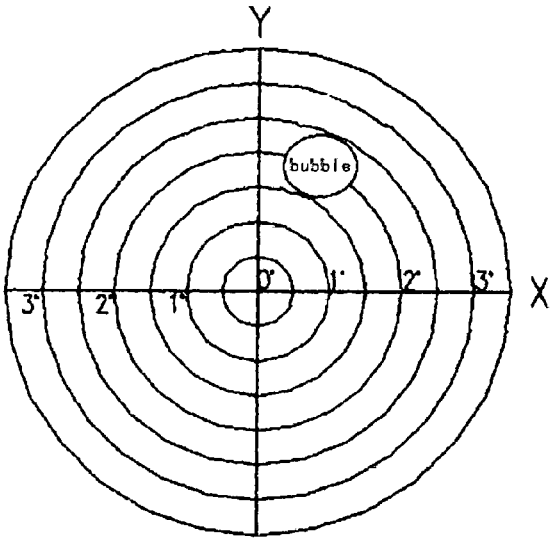
FIG. 5 is a schematic view of the special bubble level displaying the hook angle in real-time.

As shown in the FIG. 4, a part 5 in the invention is cascaded between the movable pulley 1 of the lifting pulley assembly of crane and the hook 2 or the fixed pulley 3 and the fixed point 4 of the lifting pulley assembly of crane, and a detecting device and a monitoring device of hook angle are mounted on the part 5. There are some preferred embodiments as follow:

A universal level instrument detection device of hook angle:

FIG. 5 is a special bubble formula universal level instrument of hook angle with real-time displaying, according to the follow description:

(1) both sides of the fender of the lifting pulley assembly of the mast crane have been increased by 20 cm; and both sides of the fender are made of glass; a hanger shaft is set up on the upside of the fender to install the rings; the rings use the shackle joint with the fixed point of the lifting ear of the lifting pulley assembly of crane.

(2) Mount a platform in the inside of the vacant position of fender, which satisfies that the platform plane is the horizontal plane when the hook angle is 0 degree; the cross-vertical coordinates is established in the center of the platform plane; and a universal level instrument for detecting the dip angle of the platform plane with respect to the horizontal plane is arranged.

A universal level instrument motoring device of the hook angle, according to the follow description:

(1) both sides of the fender of the lifting pulley assembly of the mast crane have been increased by 20 cm, and both sides of the fender are made of glass, a hanger shaft is set up on the upside of the fender to install the rings, the rings use the shackle joint with the fixed point of the lifting ear of the lifting pulley assembly of crane.

(2) Mount a platform on one side of the vacant position of the fender, which satisfies that the platform plane is the horizontal plane when the hook angle is 0 degree; the cross-vertical coordinates are established in the center of the platform plane; a universal level instrument for detecting the dip angle of the platform plane with respect to the horizontal plane is arranged; a wireless cameras is set above the universal level instrument; and mount a large-capacity battery for supplying the power to the motoring device of the hook angle on the other side of the vacant position of fender.

(3) The crane operator's cab is fitted with a wireless receiver and display controller matching with the wireless camera to enlarge the image of the universal level instrument for lifting and then to display the image on the screen of the monitoring positions.

A monitoring device of the hook angle with a biaxial angle sensor, according to the follow description:

(1) Firstly, both sides of the fender of the lifting pulley assembly of crane is increased by 25 cm; a fixed a beam is set up on bottom of the fender; the hook is fixed to the beam by a nut and can move along the vertical axis of the neck of the hook (with a bearing), thereby widening the distance between the pulley assembly and the neck of the hook, and providing the space for loading the detecting device of hook angle.

(2) Mount a platform inside of the vacant position of fender satisfying that the platform plane is the horizontal plane when the hook angle is 0 degree; establish the cross-vertical coordinates in the center of the platform plane; arrange a MEMS biaxial angle sensor for detecting the dimensional dip angle of the platform plane with respect to the horizontal plane and set a wireless transmitter (comprising a sensor module, a wireless transmitter module with antenna); mount a large-capacity battery for supplying the power to the motoring device of the hook angle on the other side of the vacant position of fender.

Figure 6:
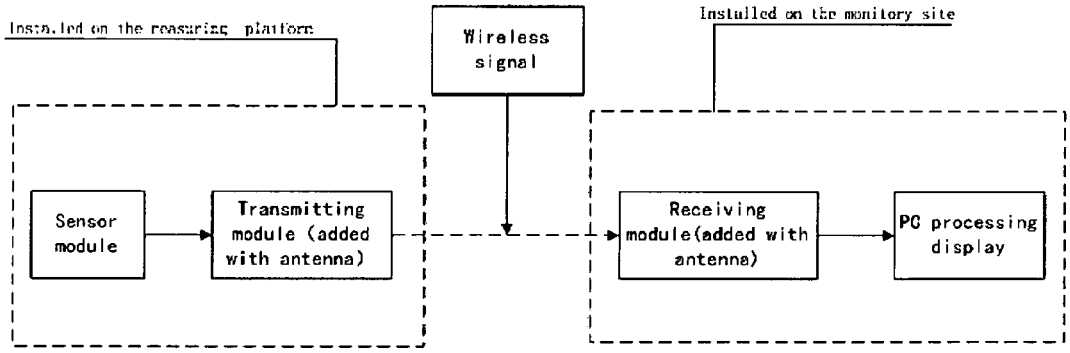
FIG. 6 a block diagram of the wireless acquisition of the hook angle with biaxial angle sensor.

(3) Mount a wireless receiver, an antenna, and a display controller (mainly comprises the wireless receiver module with the antenna and the PC) in the crane operator's cab. FIG. 6 is a block diagram of a biaxial wireless acquisition, including four parts that is the sensor module, wireless transmitter modules, wireless receiver module and the PC. The sensor module and a wireless transmitter module (with a antenna) are mounted inside the fender of the movable pulley. Wireless receiver module (with a antenna) and the PC are mounted on the monitory position. The sensor module consists of a biaxial angle sensor and the conditioning circuit. The wireless transmitter module comprises the A/D conversion section, a wireless transceiver microcontroller and a transmitter circuit. The wireless receiver module comprises the wireless transceiver microcontroller, a receiver circuit, and a serial circuit. The PC comprises mainly PC software and serial communication, and LED indication circuit.

Because the value of the angle between the platform plane and the horizontal plane is equal to the hook angle, by letting $\alpha$, $\alpha_x$, $\alpha_y$, be the hook angle of the crane, the axial component of the angle between the platform plane and the horizontal plane of the X axis and Y axis, respectively, it can show that: $(\sin \alpha_x)^2+(\sin \alpha_y)^2\approx(\sin \alpha)^2$. Also, because the hook angle is detected only to within a few degrees, so it can show that: $(\alpha_x)^2+(\alpha_y)^2\approx(\alpha)^2$, and that the axial angle of the projection of the hook angle deviating from the X axis is $\beta_x=\arctan[(\alpha_y)/(\alpha_y)]$. So, by using a microcontroller, we can output or display the hook angle value and the projection of the hook angle deviating from the X axis on LCD in real-time.

A monitoring device of hook angle with triaxial accelerometer, according to the follow description:

(1) Firstly, increase the both sides of the fender of the lifting pulley assembly of crane by 25 cm; set up a fixed beam on bottom of the fender, the hook is fixed to the beam by a nut and can move along the vertical axis of the neck of the hook (with a bearing).

(2) Mount a platform inside of the vacant position of fender satisfying that the platform plane is the horizontal plane when the hook angle is 0 degree; establish X, Y, Z-axis Cartesian coordinates in the center of the platform plane; install a triaxial accelerometer and a device for processing the measured signal and the wireless transmitting, which comprises an information processing module using the SCM to achieve the acquisition and solution of sensor signal, then send the message by the data transmission module; mount on the other side of the vacant position of fender a large-capacity battery for supplying the power to the motoring device of the hook angle.

The measured value of each axis of the triaxial accelerometer mounted on the object slowly moving along the hook can be approximated by the component of each axis of the gravitational acceleration g. According to the principle of vector operation, the $\alpha_x$ and $\alpha_y$ are the dip angle of the X axis and Y axis, respectively, which can be calculated to be:

$$\alpha_x = \arcsin\frac{g_x}{\sqrt{g_x^2+g_y^2+g_z^2}},$$

$$\alpha_y = \arcsin\frac{g_y}{\sqrt{g_x^2+g_y^2+g_z^2}};$$

in the above formula, the $g_x$, $g_y$ and $g_z$ are the measured value of each axis of the triaxial accelerometer, respectively.

Because the value of the angle between the platform plane and the horizontal plane is equal to the hook angle, by letting $\alpha$, $\alpha_x$, $\alpha_y$ be the hook angle of the crane, the axial component of the angle between the platform plane and the horizontal plane of the X axis and Y axis, respectively, it can show that: $(\alpha_x)^2+(\alpha_y)^2\approx(\alpha)^2$, and that the axial angle of the projection of the hook angle deviating from the X axis is $\beta_x=\arctan[(\alpha_y)/(\alpha_x)]$. So, by using a microcontroller, we can output or display the hook angle value and the projection of the hook angle deviating from the X axis on LCD in real-time.

(3) Mount in the crane operator's cab a receiving device comprising a receiving device for receiving the status information of motion through the same transmission module and controlling the display of the LCD.

A laser monitoring device of hook angle, according to the follow description:

(1) A part is cascaded between the fixed pulley and the fixed point of the lifting pulley assembly of crane; the part and the fixed puller are centered and fixed on both sides of the fender; the part and the rings of the fixed point of the pulley assembly use splicing connection and not in soldering connection in order to guarantee the part swing with the hook during the lifting of the crane; a platform is fixed on the part satisfying that the platform is the horizontal plane when the hook angle is 0 degree.

(2) Mount the laser angle measuring instrument in swiveling connection. Install a laser generator on the platform plane of the gantry crane; fit the front of the laser generator with a laser reflector on the columnar construction of the laser generator; and the plane of the laser reflectors is parallel to the plane of the platform. At the same time, establish the Cartesian coordinates in the plane of the platform, and make the light-spot forming by the laser generator projecting to the plane of laser reflector as the origin, marked cross coordinates, and make the origin as a circle, when the angle $\alpha$ between the platform plane and the horizontal plane that is equal to 0.25 degrees, 0.5 degrees, 1.25 degrees, 1.5 degrees, 1.75 degrees, 2 degrees, 2.25 degrees, 2.5 degrees, 2.75 degrees, 3 degrees, 3.5 degrees and 4 degrees, and make the distance r from light-spot to the origin ($r=R\tan\alpha$, R is the swivelling center to level the vertical distance) as a radius, and carve the concentric circles in the plane of laser reflector corresponding to the angle $\alpha$, and mark the corresponding angle degrees, the origin is marked 0 degree.

(3) Mount a the wireless camera below the plane of the laser reflector, located on the subassembly connecting with the columnar construction of the laser generator. Use the power line of trolley of the gantry crane to supply the power. Set a non-magnetic housing for protecting on the on the subassembly.

Figure 7:
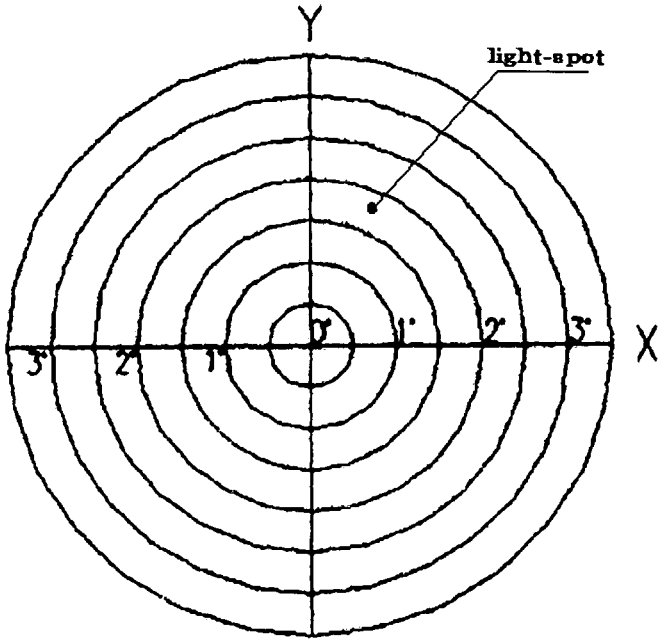
FIG. 7 is a schematic view of the laser dynamics displaying of the hook angle.

(4) Fit the crane operator's cab with a wireless receiver and display controller matching with the wireless camera to magnify the images on the plane of the laser by five and then display the image on the screen. According to the light-spots in the image and the position of the concentric circles with marked angle degrees, display the direction of the hook angel and the hook angle degrees in real-time. FIG. 7 is the laser dynamic display schematic of hook angle.

A biaxial inclinometer monitoring device of hook angle with cooperating display, according to the follow description:

(1) Firstly, increase both sides of the fender of the lifting pulley assembly of crane by 25 cm. On bottom of the fender, set up a fixed a beam. The hook is fixed to the beam by a nut and can move along the vertical axis of the neck of the hook (with a bearing), thereby widening the distance between the pulley assembly and the neck of the hook, and providing the space for loading the detecting device of hook angle.

(2) Mount a platform inside of the vacant position of fender mounted, satisfying that the platform plane is the horizontal plane when the hook angle is 0 degree; establish the cross-vertical coordinates in the center of the platform plane, and arrange a biaxial inclinometer with digital displaying, install a three-channel wireless cameras switching by the remote-controller (the switch of the remote-controller is the mounted in the crane operator's cab), and the wireless cameras is aimed at the disk of the biaxial inclinometer with digital displaying. On the other side of the vacant position of fender mount a large-capacity battery for supplying the power to the motoring device of hook angle.

(3) In the crane operator's cab, mount three sets of the three channel receiving device matching with the wireless cameras.

(4) Prepare a set or more receiving device matching with the wireless transmitting device and with the same switching channel in the crane operator's cab.

When the crane is lifting, each crane occupy a channel through the remote switch located in the crane operator's cab, and the receiving device located in the crane operator's cab, except for one receiving device switch to the native channel for dynamically displaying the hook angle outside of the crane operator's cab, and make the other receiving device switch to the cooperative channel for receiving the signal of the cooperative crane and dynamic display the hook angle in the screen of the crane operator's cab. The receiving device is provided on the monitor location of the lifting with co-party, or provided on the monitor location of the crane or other machinery without co-party display. Each crane is set up a wireless transmitting device and its support of the receiving device according to the monitoring device of the hook angle with co-party display, except for the normal operation of each crane, but can be used for the crane to lifting adding the co-party display.

Because the value of the angle between the platform plane and the horizontal plane is equal to the hook angle, by letting $\alpha$, $\alpha_x$, $\alpha_y$ be the hook angle of the crane, the axial component of the angle between the platform plane and the horizontal plane of the X axis and Y axis, respectively, it can show that: $(\alpha_x)^2+(\alpha_y)^2\approx(\alpha)^2$, and that the axial angle of the projection of the hook angle deviating from the X axis is $\beta_x=\arctan[(\alpha_y)/(\alpha_x)]$. So, by using a microcontroller, we can output or display the hook angle value and the projection of the hook angle deviating from the X axis on LCD in real-time.

Thus when lifting, it can display the biaxial inclination detected by the biaxial inclinometer monitoring device and the hook angle and the angle between the horizontal projection of the hook angle and the X axis angle on the outside of the crane operator's cab as well as on the operator's cab of the co-party and positions monitoring the lifting.

A monitoring device of the hook angle and the magnetic azimuth, according to the follow description:

(1) Firstly, increase both sides of the fender of the lifting pulley assembly of crane by 25 cm. On bottom of the fender, set up a fixed a beam. The hook is fixed to the beam by a nut and can move along the vertical axis of the neck of the hook (with a bearing), thereby widening the distance between the pulley assembly and the neck of the hook, and providing the space for loading the detecting device of hook angle.

(2) On the vacant position of the inside of the fender, fix a upper platform and a lower platform, satisfying that the planes are horizontal planes when the hook angle is 0 degree; the upper platform and the lower platform are horizontal plane and parallel to each other; in the center of the surface of the lower platform, set up the three-axis Cartesian coordinates and mount a three-axis accelerometer; in center of the upper surface of the platform, set up a three-axis Cartesian coordinates, and install a three-axis magnetometer; the Z axis of the three-axis accelerometer and three-axis magnetometer lie on a straight line; the X axis and the Y axis of the three-axis accelerometer and three-axis magnetometer are parallel to each other. On the other side of the vacant position of fender, mount a large-capacity battery for supplying the power to the motoring device of hook angle.

The inclination angle from the X-axis and Y-axis to the horizontal plane reflects the component of hook angle in the X axial and Y axial, respectively. The measured value of each axis of the triaxial accelerometer mounted on the object slowly moving along the hook can be approximated by the component of each axis of the gravitational acceleration g. According to the principle of vector operation, the $\alpha_x$ and $\alpha_y$, are the dip angle of the X axis and Y axis, respectively, which can be calculated to be $$\alpha_x = \arcsin\frac{g_x}{\sqrt{g_x^2 + g_y^2 + g_z^2}},$$

$$\alpha_y = \arcsin\frac{g_y}{\sqrt{g_x^2 + g_y^2 + g_z^2}};$$

In the above formula, the $g_x$, $g_y$ and $g_z$ are the measured value of each axis of the triaxial accelerometer, respectively.

The three-axis magnetometer can output the current magnetic field intensity values of the three axis that are mutually orthogonal in the three-dimensional space. The rotation angle of the hook is determined by the three-axis magnetometer. The rotation angle can be calculated by the following formula:

$$\phi = \theta \arctan\frac{Y_H}{X_H};$$

In the formula, the $X_H$ and $Y_H$ are the magnetic field intensity values of the X axis and the Y axis measured by the three-axis magnetometer, respectively.

Take the initial angle of the direction as magnetic north, the rotation angle with respect to the geomagnetic North Pole after the hook lifting (make the rotation angle through the error compensation due to the surrounding magnetic interference) may be determined.

Make the three-axis accelerometer as the angle sensor of the inclination. The type of the three-axis accelerometer is ADXL312. The type of the three-axis magnetometer is HMR430F149. The measured signal is transmitted by the wireless transmitter, through the signal processing module of the microcontroller MSP430F149 for signal acquisition and calculating, of the sensor, and send the measured signal by the data transmission module.

(3) In the crane operator's cab, mount a receiving device comprising receiving device for receiving the status information of motion through the same transmission module and controlling the display of the LCD.

Thus the crane operator's cab can display the hook angle and (in the direction of magnetic north initial angle) the azimuth in real-time, and by observing the electronic compass scale setting up in operator's cab, the orientation is obvious.

Figure 8:
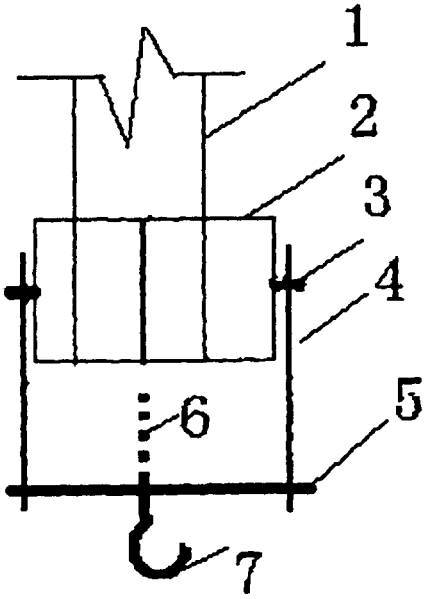
FIG. 8 is a schematic view of the first plan to increase the length of the fender.
Figure 9:
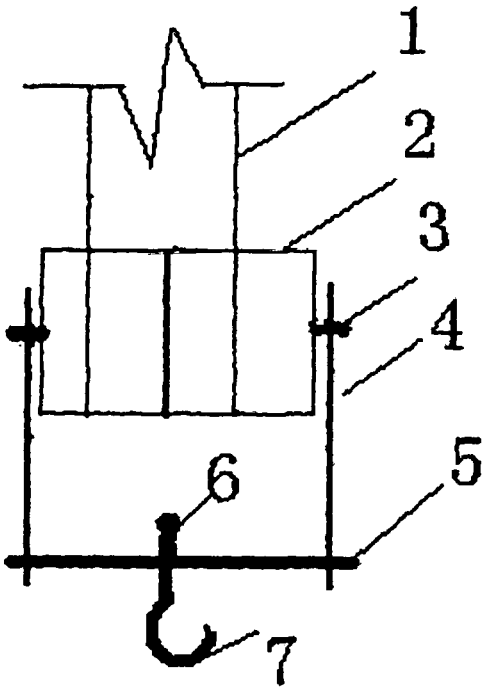
FIG. 9 is a schematic view of the second plan to increase the length of the fender.
Figure 10:
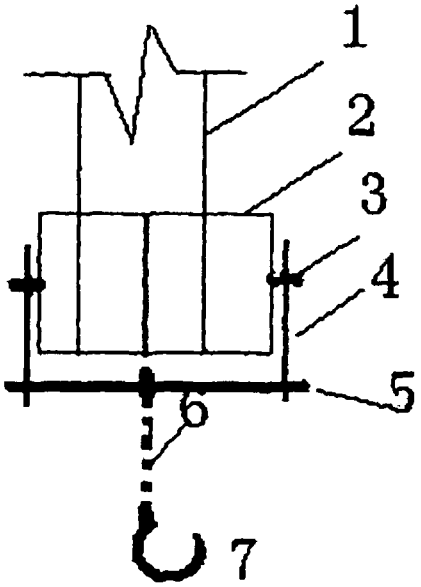
FIG. 10 is a schematic view of the plan to cascade a part.

It should be noted that the foregoing are preferred embodiments of the present invention. To those of ordinary skill, a number of changes and modifications according to the present invention shall also be considered as within the scope of the invention. Now take FIGS. 8-10 of the schematic view of the movable pulley and the assembly as an example (where the label 1 is a lifting rope, label 3 is the pulley shaft 3). After increasing on both sides of the fender 4 by a same amount, the angle measuring instrument is not installed inside the fender. Instead, increase the length of the hook stalk (the dotted line in the FIG. 8), and the angle measuring instrument is set on the increased hook stalk; or as shown in FIG. 9, install the angle measuring instrument on the end portion of hook stalk; or as shown in FIG. 10, the hook stalk 6 is increased along the beam 5, then the angle measuring instrument is installed on the increased length of the hook stalk (the dotted line in the FIG. 10). It can be considered that "between the hook and movable pulley is cascaded a part" and the end of the part is fixedly connected to the hook; the other end of the part is fixed on the beam 5 by a nut, and the part can be rotated around the vertical axis of the hook stalk. Due to the rotation of the hook, it impacts the stress of the hook. It can be considered that the angle measuring instrument mounted on the increased hook stalk or on both inner sides of the fender is equivalent. The installed measuring instruments can be Earth's magnetic field measuring instruments for geomagnetic sensor, flux gate sensors, Hall sensors, magnetic sensors, and so on. Azimuth angle measuring instrument for angle sensor can be gyroscope, universal electronic level, or a combination of test platform loft angle measuring instrument and so on, especially the universal angle measuring instrument, biaxial angle measuring instrument, triaxial angle measuring instrument or future available instruments for angle measurement and a combination of different types of instruments that can be used to dynamically detect the inclination angle of the platform plane to the horizontal plane. Certainly, a specific selection should be technical feasible and economically practical.

What is claimed is:

1. A hook angle detecting device for detecting the hook angle of a crane, comprising:

at least one angle measuring instrument;

a part installed in series between the movable pulley of the crane's raising pulley assembly and the crane hook or between the fixed pulley and the mounting point of the raising pulley assembly, said part meets the requirement that a platform surface is a horizontal plane when the hook deviation angle is 0 degree and that, under different deviation angles of the hook, the action line of the lifting force of the pulley assembly which passes through the hook is still perpendicular to the platform surface; and a platform surface fixedly installed on said part, said platform surface meets the requirement that when the hook deviation angle is 0 degree, said platform surface is a horizontal plane; said at least one angle measuring instrument is installed on said platform surface for detecting the inclination angle between said platform surface and the horizontal plane.

2. The hook angle detecting device according to claim 1, wherein one end of the part is fixed to the two side-fenders of the movable pulley or the fixed pulley.

3. The hook angle detecting device according to claim 2, wherein a said part is connected between the fixed pulley and the mounting point of the lifting pulley assembly, the two side-fenders of the fixed pulley being lengthened by equal amounts to provide a space between the inner sides of the lengthened fenders so that said platform can be fixedly installed therein.

4. A crane comprising an angle detecting device according to claim 1.

5. A monitoring device of the hook angle for a crane, comprising:

at least one angle measuring instrument, a wireless transmitting device which is used to install a detection device of the hook angle and transmit the signal of the hook angle, a plurality of receiving and controlling devices mounted on the crane operator's cab for receiving and processing the wireless signal and displaying the hook angle, a part installed in series between the movable pulley of the crane's raising pulley assembly and the crane hook or between the fixed pulley and the mounting point of the raising pulley assembly, said part meets the requirement that a platform surface is a horizontal plane when the hook deviation angle is 0 degree and that, under different deviation angles of the hook, the action line of the lifting force of the pulley assembly which passes through the hook is still perpendicular to the platform surface;

and a platform surface fixedly installed on said part, said platform surface meets the requirement of when the hook deviation angle is 0 degree, said platform surface is a horizontal plane; said at least one angle measuring instrument is installed on said platform surface for detecting the inclination angle between said platform surface and the horizontal plane.

6. The monitoring device according to claim 5, wherein one end of the part is fixed to two side-fenders of the movable pulley or the fixed pulley.

7. The monitoring device according to claim 6, wherein the part is installed between the fixed pulley and the mounting point of the lifting pulley assembly, whereby the two side-fenders of the fixed pulley are lengthened by equal amounts when one end of the part is firmly connected to the two side-fenders of the fixed pulley, said platform is fixedly installed on a vacant space located between the inner sides of the lengthened fenders, a Cartesian coordinate system is set at the center of the platform, said angle measuring instrument is installed on said platform for detecting the tilt angle of the platform relative to the horizontal plane of the platform, said wireless transmitting device and a battery for supplying the power to the wireless transmitting device being disposed on the platform.

8. A crane comprising a monitoring device of the hook angle according to claim 5.

9. A hook angle detecting device for detecting the hook angle inside of the fenders of the movable pulley of a crane, comprising:

at least one angle measuring instrument, a platform fixed on a vacant space located between the inner sides of the two fenders of the movable pulley with the fenders being equally lengthened to provide said space, whereby, the plane of the platform is horizontal when the hook angle is 0 degree, a Cartesian coordinate system is set on the center of the platform, said angle measuring instrument for detecting the tilt angle of the platform relative to the horizontal plane of the platform is disposed on the platform.

10. A crane comprising a detecting device of the hook angle inside of the fenders of the movable pulley according to claim 9.

11. A monitoring device for monitoring the hook angle inside of the fenders of the movable pulley of a crane, comprising:

at least one angle measuring instrument, a wireless transmitting device that is used to install a detection device of the hook angle and transmit the signal of the hook angle, a plurality of receiving and controlling devices mounted on the crane operator's cab for receiving and processing the wireless signal and displaying the hook angle, a platform fixed on a vacant space located between the inner sides of the two fenders of the movable pulley with the fenders being equally lengthened to provide said space, whereby the plane of the platform is horizontal when the hook angle is 0 degree, a Cartesian coordinate system is set on the center of the platform, said angle measuring instrument for detecting the tilt angle of the platform relative to the horizontal plane of the platform is disposed on the platform.

12. A crane comprising a monitoring device of the hook angle inside of the fenders of the movable pulley according to claim 11.

13. A monitoring device of a crane for monitoring the hook angle added with the cooperating party's display, comprising:

at least one angle measuring instrument installed with a detection device of the hook angle, a wireless transmitting device for transmitting the signal of the hook angle, and a plurality of receiving devices mounted in a crane operator's cab, which receive and process the wireless transmitted signals and dynamically displays the hook angles, a platform fixed on a vacant space located between the inner sides of the two fenders of the movable pulley with the fenders being equally lengthened to provide said space, whereby the plane of the platform is horizontal when the hook angle is 0 degree, a Cartesian coordinate system is set on the center of the platform, said angle measuring instrument for detecting the tilt angle of the platform relative to the horizontal plane of the platform is disposed on the platform, a set of two channel remote switching wireless transmitting device or a set of three channel remote switching wireless transmitting device and a battery for supplying power to the device are disposed on the platform, two sets of two channel switching receiving control device matching with the two channel remote switching wireless transmitting device or three sets of three channel switching receiving control device matching with the three channel remote switching wireless transmitting device are installed in the crane operator's cab.

14. The monitoring device according to claim 13, wherein when the crane is lifting, each crane occupies a channel through the remote switching located in the crane operator's cab, and the receiving control device is located in the crane operator's cab, besides one set of the receiving control device switches to the native channel for dynamically displaying the hook angle outside of the crane operator's cab, and makes the other receiving control device switch to the cooperating party's channel for receiving the signal of the cooperating party's crane and dynamically display the hook angle inside of the crane operator's cab.

15. A crane comprising a monitoring device of the hook angle added with the cooperating party's display according to claim 13.

16. A monitoring device of the hook angle and the magnetic azimuth used for the crane, comprising:

at least one angle measuring instrument, a detecting device of hook angle, a wireless transmitting device for transmitting and processing the signal of the hook angle and the magnetic azimuth, a receiving control device mounted in the crane operator's cab for receiving and processing the wireless signal and displaying the hook angle and the magnetic azimuth, a platform fixed on a vacant space located between the inner sides of the two fenders of the movable pulley with the fenders being equally lengthened to provide said space, whereby the plane of the platform is horizontal when the hook angle is 0 degree, a Cartesian coordinate system is set on the center of the platform, said angle measuring instrument for detecting the tilt angle of the platform relative to the horizontal plane of the platform is disposed on the platform, and said wireless transmitting device and a battery to supply the power of the wireless transmitting device are disposed on the platform.

17. A crane comprising a monitoring device of the hook angle and the magnetic azimuth according to claim 16.

* * * * *